United States Patent [19]

Hopkins et al.

[11] 4,350,252

[45] Sep. 21, 1982

[54] DISPLAY RACK

[76] Inventors: Grant Hopkins, 29½ Lenore; Mark Cantrell, 150 Wilbur, Box 60, both of Walla Walla, Wash. 99362

[21] Appl. No.: 168,262

[22] Filed: Jul. 10, 1980

[51] Int. Cl.[3] ..... A47F 7/00

[52] U.S. Cl. ..... 211/40; 211/50

[58] Field of Search ..... 211/40, 87, 45, 94, 211/88, 50, 55; 40/575, 611, 618

[56] References Cited

U.S. PATENT DOCUMENTS

| | | | |
|---|---|---|---|
| 1,469,162 | 9/1923 | Lesler | 211/50 |
| 3,599,799 | 8/1971 | Henli et al. | 211/40 |
| 4,119,207 | 10/1978 | Fuller et al. | 211/45 |

FOREIGN PATENT DOCUMENTS

| | | | |
|---|---|---|---|
| 14608 | 5/1911 | Denmark | 211/55 |

*Primary Examiner*—Roy D. Frazier
*Assistant Examiner*—Robert W. Gibson, Jr.

[57] ABSTRACT

A storage rack for displaying flat, rectangular articles such as record jackets along a wall surface. The rack is comprised of at least two elongated rack members mountable to a support in transverse alignment for receiving opposed side edges of the article. The rack members are grooved to receive the opposed article side edges. The openings are spaced outwardly of integral support surfaces at bottom ends of the grooves. These support surfaces bear the weight of the articles at corners thereof adjacent the opposed article side edges. An article can be removed from the rack simply by moving the article longitudinally clear of the support surfaces, shifting the article outwardly into alignment with the access opening and pulling the article longitudinally from between the rack members.

13 Claims, 6 Drawing Figures

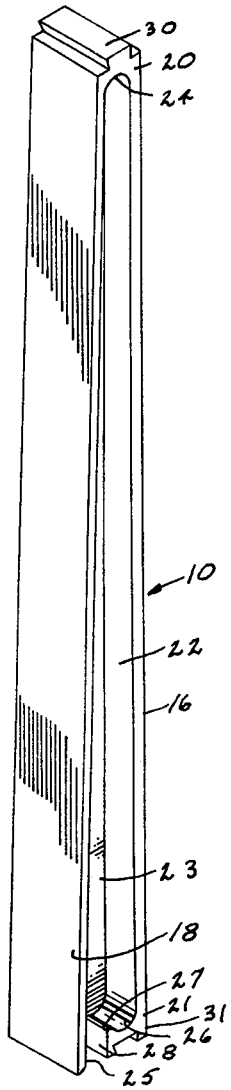
Fig 1
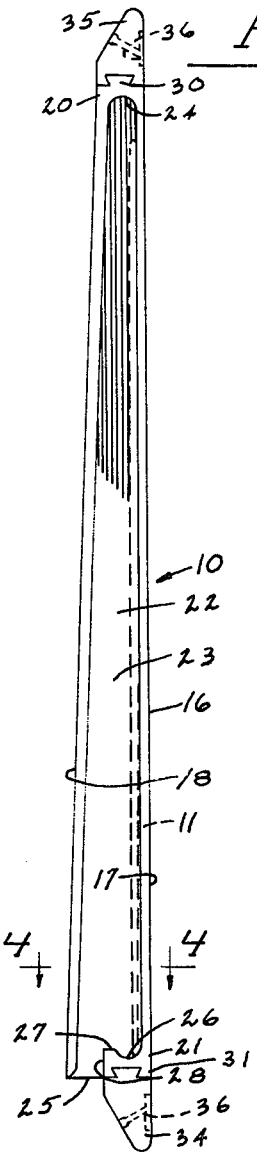
Fig 2
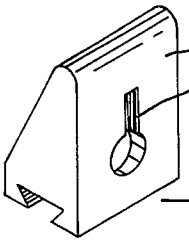
Fig 6
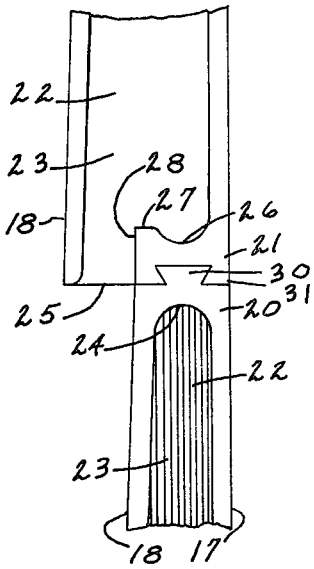
Fig 3
Fig 4
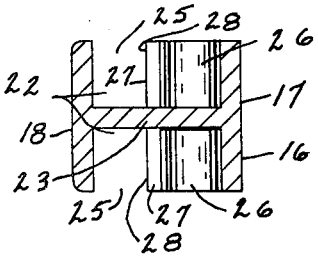
Fig 5
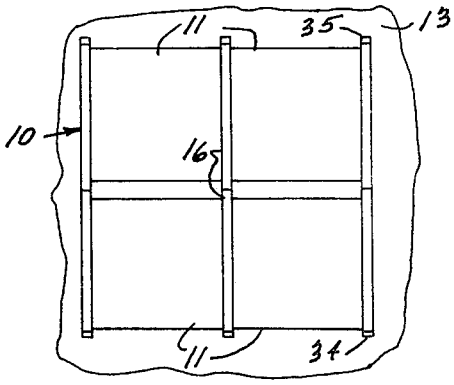

DISPLAY RACK

BACKGROUND OF THE INVENTION

The present invention is related to wall mounted display racks and more particularly to such racks used to display record jackets or other relatively flat, rectangular articles.

Long playing records very often have remarkably artistic covers or jackets that are worthy of display not only in the retail store, but also in the home. Such record covers typically reflect the mood or style of the music recorded in the enclosed recording and can thus further set the atmosphere for enjoyable listening. A person's choice of music can be said to at least be a partial reflection of his personality. A selected group of record covers may thus divulge the owner's pesonality in addition to being an aesthetically appealing wall decoration.

Another distinct advantage of displaying the record jackets in a selected array on a wall surface is the resulting accessability to the individual records for playing purposes. A recording can be located much easier when looking at an array of covers or jackets rather than by thumbing through a stack of loose covers.

There are frames currently available for hanging flat rectangular articles individually. Such frames, conceivably, coulld be used to hang record covers or similar articles from a wall surface. Frame enclosures, however, are expensive and can be used only for a single article. Additionally, access to the article is extremely limited, a feature that would discourage many music listeners.

Commercial display racks, formed of heavy wire, are also known, some such racks being free standing and others being wall mounted for displaying a series of articles. These racks are serviceable for commercial use but are hardly appealing for home use. Such racks are typically constructed in units and are not intended for the relatively small areas found in private residences. These racks are also not easily made on a physical scale small in appearance and unobtrusive when positioned on a wall surface.

The present display rack is supplied in individual rack members that can be assembled or disassembled to achieve nearly any selected rectangular shape or display size, from one record jacket to as many as desired. The rack itself is decorative, yet functional, allowing quick and easy access to any jacket supported thereby. The rack protects the records and jackets by providing individual jacket storage and support and by holding them out of the reach of small children.

BRIEF DESCRIPTION OF THE DRAWINGS

FIG. 1 is a pictorial view of a single rack member;

FIG. 2 is a side elevation view of a rack member and mounting clips for securing the rack member to a wall surface;

FIG. 3 is an enlarged fragmentary view showing interfitted ends of two rack members;

FIG. 4 is a sectional view taken along line 4—4 in FIG. 2;

FIG. 5 is a diagrammatic view exemplifying one arrangement of the present rack and the record jackets supported thereby; and FIG. 6 is a pictorial view of a mounting member.

DETAILED DESCRIPTION OF A PREFERRED EMBODIMENT

The present invention deals specifically with a storage and display rack for supporting flat rectangular articles, preferably record jackets 11. The jackets 11 are preferably supported along upright side edges with their faces held substantially parallel to a supporting wall 13.

The present display rack 10 is comprised of at least two members 16 that are mountable to a support such as a wall and can be selectively interfitted for use in any convenient pattern or rectangular array.

The individual rack members 16 each include an elongated back surface 17 that is adapted to fit flush along the outer surface of the wall. A front surface 18 longitudinally overlaps the back surface 17 and is spaced outwardly therefrom. The front surface 18 is preferably angularly offset from the back surface, forming an acute angle diverging from a first end 20 of the member to a second end 21.

An elongated groove 22 extends along the length of each member 16. Groove 22 is defined on opposed sides by the front and back surfaces and is divided longitudinally by a web 23. The web 23 extends between the front and back surfaces along the full length of the members 16, substantially dividing groove 22 into two equal longitudinal halves. This feature is best indicated in FIG. 4.

The groove halves 22 are closed at ends 24 situated directly adjacent the first member end 20. Openings 25 may be situated adjacent at the second end 21 to allow longitudinal access to the groove by the side edges of an album.

Support surfaces 26 may project outwardly from the back surfaces 17 at the second ends 21. The support surfaces 26 are somewhat concave, having raised lips 27 situated at outward ends. The raised lips 27 and concave surfaces 26 may each receive and support the bottom corners of one or more record jackets to prevent the jackets from sliding accidently from the groove 22. An outward surface 28 on each support surface 26 defines one side of the associated opening 25. The remaining side is defined by an inwardly facing part of the front surface 18.

The openings 24, as noted in FIGS. 1 and 2, are preferably located at the second member end 21 beyond the support surfaces 26. This arrangement is preferable to conceal the openings and adjacent support surfaces from normal view. However, the openings could be spaced somewhat toward the first end 21 from the surfaces 26 (toward the end 20) and still function properly. In fact, it is conceivable that no openings 24 be provided and that loading of the covers be accomplished by a "side loading" procedure that will be explained later in this specification.

Several successive rack members 16 can be interfitted through provision of integral joint fittings formed along the first and second ends 20 and 21. Preferably, the first end 20 includes a male dovetail fitting 30 and the second end 21 includes a female dovetail fitting 31. The fittings 30 and 31 are complementary, so the male fitting 30 of one rack member 16 may be releasably received (as shown in FIG. 3) by the female fitting of a different rack member. The fittings are positioned along the respective first and second ends so when two rack members are joined together, their adjoining back surfaces 17 become coplanar. Furthermore, the front surface 18 of each member at its first end 20 is spaced outwardly from the back surface 17 by a distance equal to the distance from the back surface 17 to the outward surfaces 28 of the support. The front surfaces will not, therefore, obstruct access to the openings 25. In fact, the front surface 18 of one member can serve as a guide, directing an album jacket toward the openings 25.

The display rack member 16 may be mounted to a support by means such as nailing or otherwise fastening individual members to the wall through the back surfaces 17. Preferably, however, mounting members are provided in the form of clips that will accomplish the function of mounting the members to the wall and visually hiding the joint fittings 30 and 31. A male wall mounting clip 34 and a female wall mounting clip 35 are shown in FIG. 2. The female clip 35 is shown in detail by FIG. 6. The male clip 34, as implied, includes a male dovetail fitting, and the female clip 35 includes a female fitting. Both clips 34 and 35 preferably include keyhole mounts 36 (FIG. 2) for securing the clips and attached rack members to a support. The keyhole mounts are shaped to receive the headed ends of nails or screws. Such mounts facilitate temporary mounting and will minimize damage to the support.

Support other than a wall (or other upright support) can be utilized with only slight modification of the clips. For example, the clip shown in FIG. 6 could be supplied as an elongated extrusion (not shown) with a long dovetail fitting member with upwardly facing mounts. The elongated clip could be attached to a ceiling or other horizontal overhead support. Several "strings" of interconnected rack members could then be suspended from the single long clip member to function as a suspended partition when loaded with record album jackets.

A selected number of the display rack members 16 can be mounted in laterally opposed pairs in nearly any configuration desired along a planar wall surface. One member is secured to the wall surface either by a male or female mounting clip. A successive member can be attached to the wall mounted member by securing its appropriate end fitting to the free fitting end of the mounted member. When a desired number of interfitted members have been appropriately positioned along the wall surface, the free end of the "string" is attached to the wall by another appropriate mounting clip. Before this is done, the interconnected members are preferably plumbed to assure their vertical orientation.

After a vertical group of members have been secured to the wall, a second adjacent group can be interfitted and connected. This is done by spacing the vertical groups transversely a distance slightly greater than the width of a record jacket. The second group is then mounted in horizontal alignment with the first by use of a spirit level, resting one end on the top or bottom end of the first group and the remaining level end against a corresponding end of the second group. When the lateral distance and horizontal alignment is attained, the second group can be attached to the wall in a manner similar to the steps used in attaching the first. Successive assembled groups can be wall mounted in the same way. The result is a succession of vertical strips of interconnected members 16 spaced apart horizontally along a wall surface. It is noted that it is not necessary that successive vertical groups of the members be interfitted, but that individual members can be secured to the wall to produce nearly any desired rectangular pattern.

Record jackets are inserted between horizontally opposed members by lifting the jacket vertically by its bottom edge through the downwardly facing openings 25. The bottom edge of the jacket is lifted upwardly over the lips 27 and then shifted toward the wall over the supports 26. The record album can then be lowered until the bottom corners of the jacket come into engagement with the respective supports 26. The upright edges of the jacket are secured within the opposed member 16 by the front surface 18.

Removal of an individual jacket from the present rack is accomplished by lifting the bottom edge of the record album over the lip 27 and pulling the edge outwardly into longitudinal alignment with the openings 25. The jacket will then slide gravitationally from the confines of the inwardly facing grooves 22.

FIG. 5 represents three groups of two interconnected members 16 arranged for supporting four record jackets 11. It is understood this pattern can be added to or taken away from in any manner desired to produce a different geometric shape. It is also pointed out that the use of clips 34 and 35 result in only two mounting holes formed in the wall surface for each "string" of interfitted members. There is therefore very little damage done to the wall surface in mounting or removing the present rack.

It should be noted that the vertical installation of the member shown in the drawing and described above is preferred. However, the rack members could well be mounted horizontally with the openings 25 oriented vertically. With this arrangement, records could be slipped horizontally into and out of the grooves, with the webs 23 then becoming the album support surfaces.

Another modification of the present invention is envisioned wherein the support surfaces 26 would project between the back and front surfaces, closing the openings 25. With this modification, one side of a record album could be inserted sideways into one groove until the opposite album side cleared the front surface of the opposed rack member. The album would then be moved inwardly into alignment with both grooves and slid backwardly until part of the album is received within both grooves. The album cover could then rest on the closed support surface 26. It should be noted here also that the modified form of our invention could be used in a horizontal orientation, with loading being accomplished with vertical movement of the album cover.

The above description has been given to set forth an example of a preferred form of the present invention. Various other forms or modifications may be envisioned that fall within the scope of the appended claims.

Having thus described our invention, we claim:

1. A storage rack mountable to a support for receiving and fully displaying individual thin rectangular articles such as record albums having opposed parallel side edges, comprising:

a pair of elongated rack members adapted to be mounted to the support in spaced parallel orientation;

each of said rack members having (a) an elongated back surface; (b) an elongated front surface longitudinally overlapping the back surface and spaced outwardly therefrom to form a longitudinal groove adapted to receive a side edge of the rectangular article; (c) a closed first end joining the front and back surfaces and (d) a second end spaced longitudinally from the first end;

a support surface on each rack member projecting from the back surface across said groove toward the front surface adapted to receive and support a side edge of the rectangular article at a location thereon adjacent the side edge received by the longitudinal groove;

article access openings formed between the back surfaces and front surfaces adjacent the second ends of said rack members enabling access to the longitudinal grooves and support surfaces by the rectangular article;

wherein the rack members are mountable to the support with the longitudinal grooves facing one another and spaced apart to receive and support parallel side edges of the rectangular article with the article in an upright, fully exposed position;

a male joint fitting at one end of each rack member; and a female joint fitting at the remaining end of each rack member for releasably receiving a male fitting thereby enabling the rack members to be connected end-to-end.

2. The storage rack as claimed by claim 1 further comprising a mounting means having a connector member receivable by one of the joint fittings and adapted to be secured to the support.

3. The storage rack as claimed by claim 1 wherein each rack member includes a web connecting the front and back surfaces and extending from the closed first end to the second end, dividing the groove into two elongated halves; and wherein said support surfaces are transverse to the webs and back surfaces.

4. The storage rack as claimed by claim 1 further comprising a mounting means releasably received on said rack members for allowing mounting of said rack members to a support such as a wall.

5. The storage rack as claimed by claim 4 wherein the article access openings are spaced outwardly adjacent said support surfaces.

6. The storage rack as claimed by claim 1 wherein the article access openings are spaced outwardly adjacent said support surfaces.

7. The storage rack as claimed by claim 1 wherein the support surfaces each include a lip projecting toward the closed first end and defining one side of said article access opening.

8. A storage and display rack for thin rectangular articles having pairs of parallel side edges such as record albums mountable to an upright support such as a wall, comprising:

a pair of elongated rack members adapted to be mounted to the upright support in parallel spaced relation;

said rack members having (a) elongated back surfaces adapted to fit flush with an upright support and in parallel upright orientation thereon; (b) elongated front surfaces longitudinally overlapping the back surfaces and spaced outwardly therefrom to form longitudinal grooves adapted to receive opposed parallel side edges of an article with the front surfaces overlapping the article side edges received within the grooves and with the article fully exposed to view between the rack members; (c) closed top ends joining the front and back walls and (d) bottom ends;

an article supporting surface at the bottom end of each rack member projecting from the back surface across said groove toward the front surface adapted to engage and support a side edge of an upright article adjacent the edge received by the longitudinal groove;

article access openings formed between the back surfaces and front surfaces adjacent the bottom ends of said rack members allowing access to the longitudinal grooves and article supporting surfaces; and mounting means on the rack members for attaching said rack members to the upright support;

a male joint fitting at one end of each rack member; and a female joint fitting at the remaining end of each rack member for releasably receiving a male fitting, thereby enabling the rack members to be connected end-to-end.

9. The storage rack as claimed by claim 8 wherein each rack member includes a web connecting the front and back surfaces and extending from the closed top end to the bottom end, dividing the groove into two elongated halves, and wherein said support surfaces are transverse to the webs and back surfaces.

10. The storage rack as claimed by claim 8 wherein the article access openings are spaced outwardly adjacent said support surfaces.

11. A storage rack for displaying individual thin rectangular articles having parallel side edges such as record albums, in an upright orientation on a support comprising:

a pair of elongated rack members adapted to be mounted to the support in parallel orientation to receive a rectangular article therebetween;

each of said rack members having (a) an elongated back surface; (b) an elongated front surface longitudinally overlapping the back surface and spaced outwardly therefrom to form a longitudinal groove adapted to receive an edge of an article with the front surface overlapping the received article edge (c) a first end joining the front and back walls and (d) a second end opposite the first end; and a support surface on each rack member projecting from one of the surfaces across said groovve toward the remaining surface adapted to receive and support an article along an edge thereof adjacent the edge received by the groove;

a male joint fitting at one end of each rack member; and a female joint fitting at the remaining end of each rack member;

wherein the female joint fitting of one rack member is shaped to releasably receive the male joint fitting of the remaining rack member.

12. The storage rack as claimed by claim 11 wherein each rack member includes a web connecting the front and back surfaces and extending from the first end to the second end, dividing the groove into two elongated halves with each half adapted to receive a side edge of a thin rectangular article.

13. A storage rack mountable to a support surface for fully displaying individual thin rectangular articles having opposed pairs of parallel side edges such as record albums, comprising:

a plurality of elongated rack members adapted to be supported in parallel spaced relation;

each of said rack members having (a) an elongated back surface, (b) an elongated front surface longitudinally overlapping the back surface, (c) a web interconnecting the front and back surfaces, spacing the surfaces apart and forming oppositely facing longitudinal grooves between the front and back surfaces, each groove adapted to receive an edge of one pair of parallel side edges of an article, (d) a first end joining the front and back surfaces, (e) a second end opposite the first end, and (f) support surfaces projecting from one of the surfaces acros the grooves toward the remaining surface, adapted to receive and support an upright article along an edge thereof adjacent an article side edge received within the groove;

said rack members being adapted for arrangement to receive and fully display individual upright articles from within facing grooves of adjacent parallel members, with the received articles being arranged in selected geometric patterns as determined by selective arrangement of the rack members on the support surface.

* * * * *